US010788241B2

(12) United States Patent
Frederick et al.

(10) Patent No.: US 10,788,241 B2
(45) Date of Patent: Sep. 29, 2020

(54) AIR CONDITIONER WITH CONDENSATION DRAIN ASSEMBLY AND IMPROVED FILTER RACK

(71) Applicant: Rheem Manufacturing Company, Atlanta, GA (US)

(72) Inventors: Kenneth D. Frederick, Fort Smith, AR (US); Karl S. Tallakson, Greenwood, AR (US); Robert L. Long, Fort Smith, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 148 days.

(21) Appl. No.: 15/795,063

(22) Filed: Oct. 26, 2017

(65) Prior Publication Data

US 2019/0128560 A1 May 2, 2019

(51) Int. Cl.

| | |
|---|---|
| ***F24F 13/22*** | (2006.01) |
| *F24F 11/86* | (2018.01) |
| *F24F 11/74* | (2018.01) |
| *F24F 13/28* | (2006.01) |
| *F24F 110/10* | (2018.01) |

(52) U.S. Cl.

CPC ..... *F24F 13/222* (2013.01); *F24F 11/74* (2018.01); *F24F 11/86* (2018.01); *F24F 13/28* (2013.01); *F24F 2013/227* (2013.01); *F24F 2110/10* (2018.01); *F24F 2221/54* (2013.01)

(58) Field of Classification Search

CPC ..... F24F 13/222; F24F 13/28; F24F 2221/54; F24F 2110/10; F24F 11/86; F24F 2013/227; F24F 11/74; F24F 13/224; F24F 13/22; F25D 21/14

See application file for complete search history.

(56) References Cited

U.S. PATENT DOCUMENTS

| | | | | |
|---|---|---|---|---|
| 5,904,053 | A * | 5/1999 | Polk | F24F 13/22 62/285 |
| 5,964,370 | A * | 10/1999 | Rust, Jr. | F24F 1/0007 220/571 |
| 5,987,909 | A * | 11/1999 | Martin, Sr. | F24F 13/222 62/288 |
| 6,557,364 | B2 * | 5/2003 | Gunji | F24F 1/0007 62/263 |
| 6,901,766 | B1 * | 6/2005 | Jin | F24F 1/0007 62/286 |
| 6,978,909 | B2 * | 12/2005 | Goetzinger | F24F 13/222 220/571 |
| 8,511,108 | B2 * | 8/2013 | Yabu | F24F 1/0047 62/426 |

(Continued)

*Primary Examiner* — Frantz F Jules
*Assistant Examiner* — Martha Tadesse
(74) *Attorney, Agent, or Firm* — Troutman Pepper Hamilton Sanders LLP

(57) ABSTRACT

A condensate drain assembly includes a drain pan configured to receive condensate from an evaporator coil of an air conditioning system. The drain pan is configured to be removed from the air conditioning system. The condensate drain assembly also includes a drainage pipe configured to translate the condensate from the drain pan to a drain located beneath the air conditioning system and a drain pan end cap. The drain pan end cap includes a first aperture configured to drain the condensate from the drain pan and a second aperture configured to align with the drainage pipe.

9 Claims, 14 Drawing Sheets

(56) References Cited

U.S. PATENT DOCUMENTS

| | | | | |
|---|---|---|---|---|
| 9,989,268 | B1 * | 6/2018 | Spanger | F24F 1/02 |
| 2002/0144513 | A1 * | 10/2002 | Gunji | F24F 1/0057 62/263 |
| 2005/0236013 | A1 * | 10/2005 | Huston | B63J 2/04 134/1 |
| 2007/0113574 | A1 * | 5/2007 | Davenport | F24F 13/224 62/285 |
| 2007/0245757 | A1 * | 10/2007 | Inoue | F24F 1/0007 62/259.1 |
| 2008/0245091 | A1 * | 10/2008 | Logsdon | E03C 1/12 62/285 |
| 2009/0071181 | A1 * | 3/2009 | Spanger | F24F 13/222 62/262 |
| 2010/0175408 | A1 * | 7/2010 | Korda | F16N 31/002 62/291 |
| 2011/0019984 | A1 * | 1/2011 | Glover | F24F 13/222 392/465 |
| 2011/0265508 | A1 * | 11/2011 | Piccione | F24F 13/222 62/291 |
| 2012/0031134 | A1 * | 2/2012 | Shirota | F24F 1/0059 62/288 |
| 2012/0159981 | A1 * | 6/2012 | Beck | F24F 13/222 62/291 |
| 2014/0238506 | A1 * | 8/2014 | Adams | F24F 13/222 137/312 |
| 2015/0153095 | A1 * | 6/2015 | Mercer | F25D 21/14 62/291 |

* cited by examiner

AIR CONDITIONER WITH CONDENSATION DRAIN ASSEMBLY AND IMPROVED FILTER RACK

FIELD OF THE INVENTION

Example embodiments generally relate to air conditioning systems and, in particular, relate to air conditioning systems with removable condensate drains and/or filter racks.

BACKGROUND OF THE INVENTION

Large air conditioning systems, such as for commercial applications, may generate a significant amount of condensate from one or more evaporator coils. The condensate may be drained from the air conditioning system via a drain pan and/or piping. In some air conditioning locations, a drain may be placed substantially under the air conditioning system. When the drain is under the air conditioning system, a drain pan for the evaporator coil may include a drain port to direct condensate into the drain. However, the direct drainage from the drain pan, however, may prevent the drain pan from being removable.

In other air conditioning locations, the drain may be common to several air conditioning systems or otherwise located remotely from the air conditioning system. When the drain is located remotely from the air conditioning system, piping may be run from the drain pan to the drain. The piping may be removable, such that the drain pan may be removed for cleaning or other maintenance. Due to the different types of drainage locations, the drainage systems used for the air conditioning systems may require modification or the types of air conditioning systems which may be installed may be limited.

Air conditioning systems typically have filters disposed at an air intake before at least one of the heat exchanger coils. The filters are provided in varying thicknesses, though a filter rack for a given air conditioning system is configured to receive a filter of only one thickness.

SUMMARY OF THE INVENTION

Some example embodiments may enable the provision of condensate drain assembly for an air conditioning system. According to some example embodiments, a condensate drain assembly has a drain pan disposed below an evaporator coil of an air conditioning system so that the drain pan receives condensate from the evaporator coil. The drain pan is removably disposed within the air conditioning system, and a lowest vertical position of a bottom surface of the drain pan is at an end of the drain pan. A drainage pipe has a first end disposed proximate and lower than the end of the drain pan and a second end secured to the air conditioning system so that the second end is in fluid communication with an exterior of the air conditioning system via an exterior surface of the air conditioning system and is below the first end so that fluid within the drainage pipe flows away from the first end and towards the second end. A first drain pan end cap has a first aperture at the end of the drain pan so that fluid in the drain pan drains from the drain pan through the first aperture and a second aperture aligned with the first end of the drainage pipe.

In another embodiment, an air conditioning system has an evaporator coil and a condensate drain assembly. The condensate drain assembly has a drain pan disposed below the evaporator coil so that the drain pan receives condensate from the evaporator coil. The drain pan is removably disposed within the air conditioning system, and a lowest vertical position of a bottom surface of the drain pan is at an end of the drain pan. A drainage pipe has a first end disposed proximate and lower than the end of the drain pan and a second end secured to the air conditioning system so that the second end is in fluid communication with an exterior of the air conditioning system via an exterior surface of the air conditioning system and is below the first end so that fluid within the drainage pipe flows away from the first end and towards the second end. A first drain pan end cap has a first aperture at the end of the drain pan so that fluid in the drain pan drains from the drain pan through the first aperture, and a second aperture aligned with the first end of the drainage pipe.

In an embodiment, a filter rack disposed within an air conditioning system includes a frame having a bottom side elongated in a first direction, a first side elongated in a second direction transverse to the first direction, a second side elongated in the second direction parallel to the first side, and a top side elongated in the first direction parallel to the bottom side. The bottom side, first side, second side, and top side are secured with respect to each other to thereby define an interior volume. At least one air filter is received within the volume so that the bottom side, first side, second side, and top side restrict movement of the at least one filter in the first direction and the second direction. A retainer has a portion extending into a volume defined by a projection of a perimeter, defined by the bottom side, the first side, the second side, and the top side, in a third direction perpendicular to a plane defined by the first direction and the second direction. The retainer is disposed on the frame movably between a first position of the retainer portion and a second position of the retainer portion. The first position and the second position are offset from each other in the third direction. A detent is attached to the frame and disposed with respect to the retainer so that the detent receives and retains the retainer selectively in the first position and the second position. A stop surface is disposed with respect to the frame so that the stop surface restricts movement of the air filter in the third direction.

In a still further embodiment, an air conditioning system has a heat exchanger, a fan disposed with respect to the heat exchanger so that the fan is actuatable to move an air flow across the heat exchanger, a refrigerant path having a portion that passes through the heat exchanger, and a pump disposed in the refrigerant path and being actuatable to move refrigerant through the refrigerant path from the pump to the heat exchanger and from the heat exchanger back to the pump. A frame is disposed with respect to the heat exchanger so that the air flow flows through the frame and having at least one air filter disposed within the frame. A retainer is attached to the frame and is moveable with respect to the frame and the at least one filter between a first position of the retainer and a second position of the retainer. The first position and the second position are offset from each other in the direction of the air flow. A detent is attached to the frame and disposed with respect to the retainer so that the detent receives and retains the retainer selectively in the first position and the second position.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
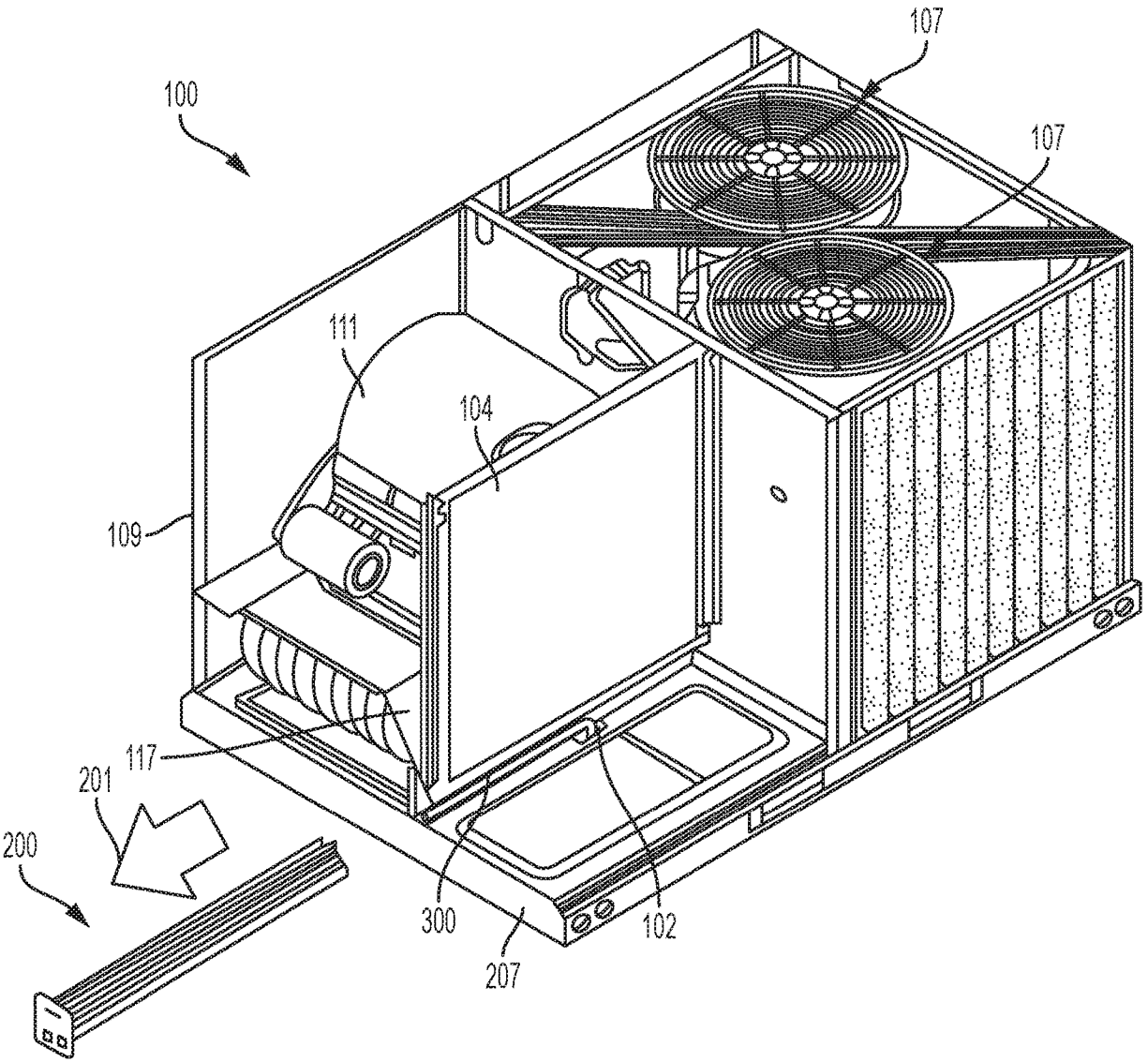
FIG. 1 is a perspective view of an air conditioning system according to an example embodiment.

The present drawings are not necessarily drawn to scale. Repeat use of reference characters in the present specification and drawings is intended to represent same or analogous features or elements of the invention according to the disclosure.

DESCRIPTION OF THE PREFERRED EMBODIMENTS

Some example embodiments now will be described more fully hereinafter with reference to the accompanying drawings, in which some, but not all, example embodiments are shown. Indeed, the examples described and pictured herein should not be construed as being limiting as to the scope, applicability, or configuration of the present disclosure. Like reference numerals refer to like elements throughout. As used herein, "operable coupling" should be understood to refer to direct or indirect connection that, in either case, enables functional interconnection of components that are operably coupled to each other.

As used herein, terms referring to a direction or a position relative to the orientation of the air conditioning system and/or condensate drain assembly, such as but not limited to "vertical," "horizontal," "above," or "below," refer to directions and relative positions with respect to the air conditioning system's and/or condensate drain assembly's orientation in its normal intended operation, as indicated in FIG. 1.

Further, the term "or" as used in this disclosure and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provided illustrative examples for the terms. The meaning of "a," "an," and "the" may include plural references, and the meaning of "in" may include "in" and "on." The phrase "in one embodiment," as used herein does not necessarily refer to the same embodiment, although it may.

As indicated above, some example embodiments relate to provision of a condensate drain assembly for an air conditioning system. In one example, the condensate drain assembly includes a removable drain pan configured to receive condensate from the evaporator coil of the air conditioning system. Additionally, the condensate drain assembly includes a drainage pipe configured to translate the condensate from the drain pan to a drain located beneath the air conditioning system. The drain pan includes a drain pan end cap including two apertures, such that, in a first configuration of the system, the condensate is drained through the first aperture without passing through the drain pipe and, in a second configuration, the condensate is drained through the first aperture and the drainage pipe via the second aperture. This enables an air conditioning system to be installed with a drain located under the air conditioning system or a drain located remotely from the air conditioning system. In some instances, a U-connector may be used to fluidly connect the drain pan and the drainage pipe via the first and second apertures. In an example embodiment, the U-connector includes a condensate trap, which may be more convenient than a condensate trap located beneath the air conditioning system.

FIG. 1 illustrates a perspective view of an air conditioning system 100 according to an example embodiment. The air conditioning system may include an evaporator coil 104 and a condensate drain 102. In an example embodiment, the air conditioning system 100 may include a drain pan 200 disposed below and configured to catch or otherwise receive condensate falling from evaporator coil 104. Additionally, air conditioning system 100 may include a drainage pipe 300 to translate the condensate from drain pan 200 to drain 102. Air conditioning system 100 may be disposed, for example, on a platform disposed at a predetermined position at the building serviced by the air conditioning system for the purpose of supporting the system. A drain 102 may be provided through the center of the platform, leading to a conduit for delivering condensate to a remote location. In such instances, it may be desirable that drain pan 200 communicates with such a center drain 102 so that condensate from pan 200 can be dispensed through the drain. However, in further configurations, the air conditioning system may be located on a platform or otherwise at a location without a preexisting drain, or it may be otherwise preferred to deliver the condensate to a drain remote from the footprint of the air conditioning system. In certain embodiments as described herein, the air conditioning system provides a condensate drain assembly that facilitates connection of the air conditioning system condensate drain pan with either of a dedicated drain below or otherwise proximate the air conditioning system or to a drain remote from the air conditioning system.

In an example embodiment, drain pan 200 is removable from air conditioning system 100 for reasons such as cleaning or other maintenance. In some example embodiments, drain pan 200 is configured to be removed in a direction of longitudinal extension of drain pan 200, as indicated by arrow 201. In an example embodiment, and referring also to FIGS. 3 and 6, drain pan 200 slides on forms in air conditioning system 100 when being removed and replaced. For example, a laterally extending flange 213 extends from a first flange 218 of an upper, shroud portion 214 of drain pan 200 and rides slidably on a generally flat upper surface of a sloped lower flange 415 of a rectangular frame 401 of an air filter rack 400 (FIGS. 12 and 13), while a hooked-shaped flange 215 of a second flange 220 of upper, shroud portion 214 is received by an elongated, correspondingly J-shaped sheet metal feature 119 attached to the housing of fan 111 (discussed below). As discussed in more detail below, the drain pan is held in place, in part, by a frictional engagement between its upper flanges and other system components, but it should be understood that other mechanisms may be used in place of or in addition to such means, and in certain embodiments a plurality of screws extending through the drain pan and fixtures attached to the housing of air conditioning system 100 are used to hold drain pan 200 in position. Drainage pipe 300 is disposed substantially parallel with the longitudinal direction of extension of drain pan 200, such that drain pan 200 is disposed substantially above the drainage pipe 300 when drain pan 200 is installed in air conditioning system 100.

Figure 2:
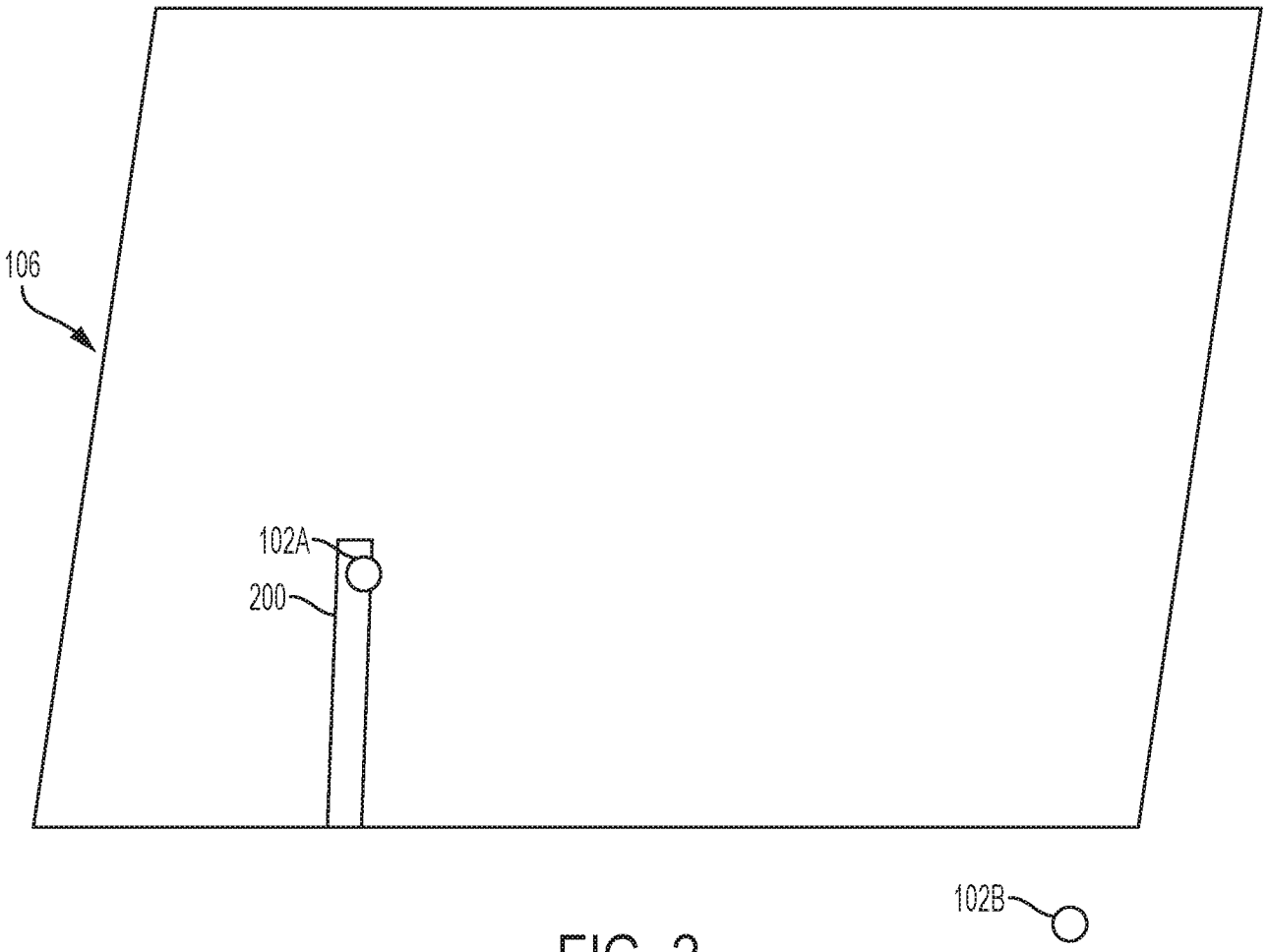
FIG. 2 is a schematic view of air conditioning drainage locations according to an example embodiment for use with the air conditioning system of FIG. 1.

FIG. 2 illustrates example locations of air conditioning drains 102 according to an example embodiment. As discussed above, an air conditioning system location 106 may have a drain 102 located beneath air conditioning system 100, such as drain 102A. Drain 102A may be centered under air conditioning system 100 or disposed at any other convenient location beneath air conditioning system 100. Alternatively, drain 102 may be located remote from air conditioning system location 106, such as drain 102B. Remote drain 102B may be a common drain for a plurality of air conditioning systems 100 or other drainage piping for a building or location.

Figure 3:
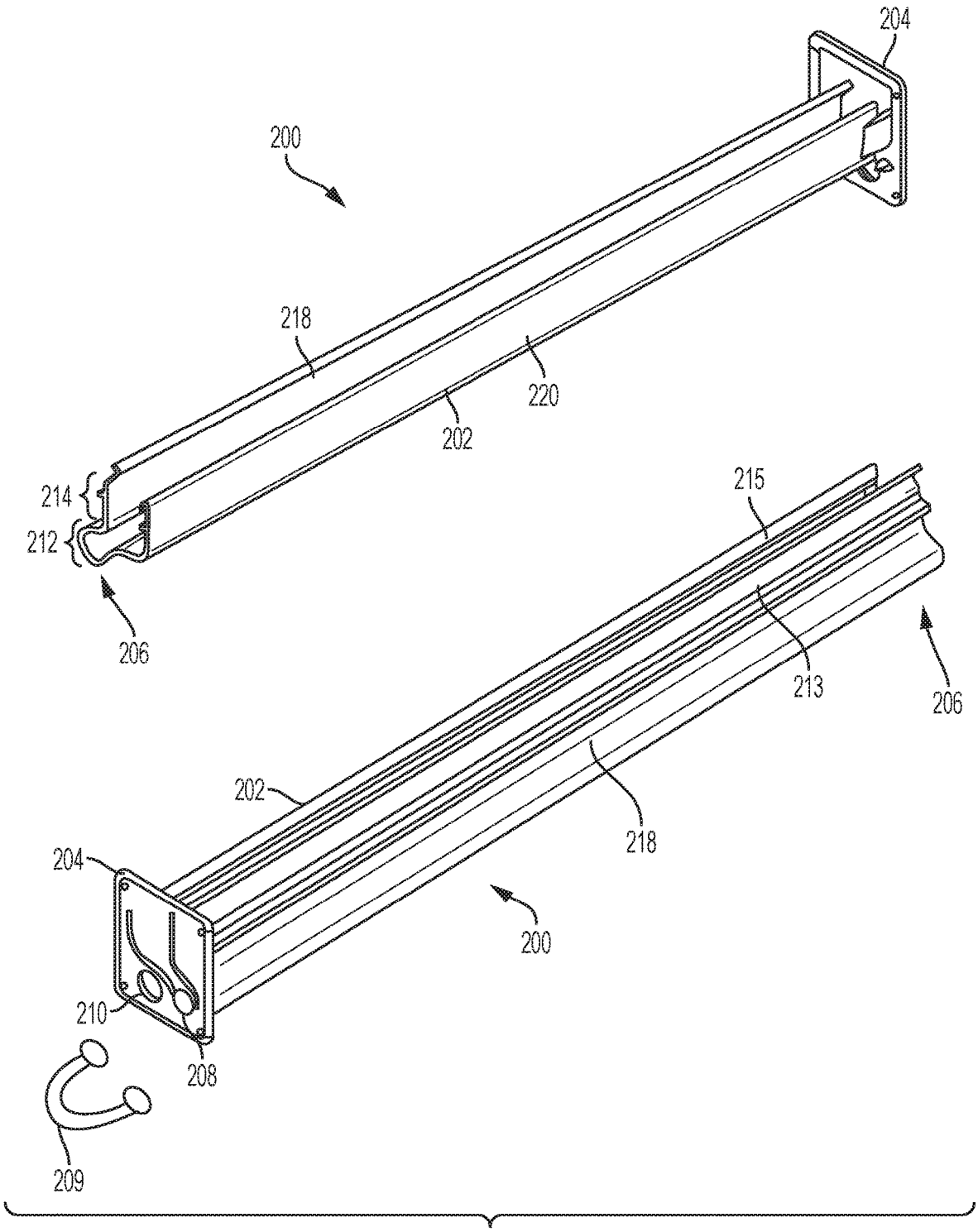
FIG. 3 illustrates perspective views of an example drain pan according to an example embodiment for use the air conditioning system of FIG. 1.

FIG. 3 illustrates perspective views of an example drain pan 200 according to an example embodiment. Drain pan 200 comprises an elongated portion 202 that is formed of polymer, metal, or other suitable material, and may be formed by molding, stamping, extrusion, or the like. Drain pan 200 may have a generally U shape vertical cross-section and include a first end cap 204 at a first end of the drain pan and a second end cap 206 at a second end of the drain pan. First end cap 204 and second end cap 206 close at least a portion of the first and second ends of drain pan 200. Drain pan elongated portion 202 comprises a shroud portion 214 and a trough portion 212. Shroud portion 214 comprises a pair of opposing flanges 218 and 220 that face at least a portion of evaporator coil 104 of air conditioning system 100 to receive falling condensate. Flanges 218 and 220 define a gap between them that is closed below the flanges by a trough portion 212, which is disposed below the flanges and is attached to the flanges at the flanges' lower longitudinal edges. Thus, trough portion 212 is configured to receive the condensate drawn by gravity from shroud portion 214. Trough portion 212 conveys the received condensate to a first aperture 208, as discussed below.

Figure 6A:
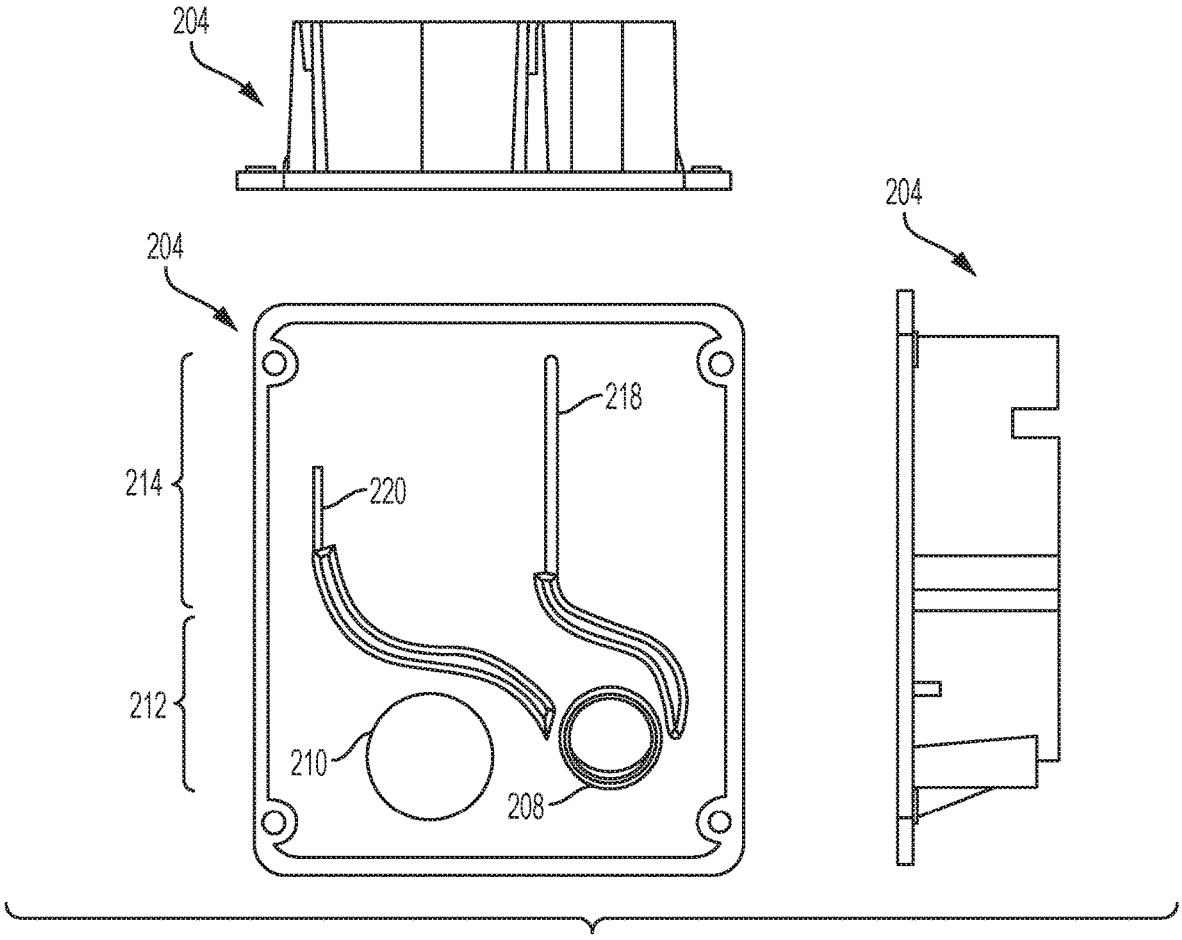
FIG. 6A illustrates front, top, and side views of an example drain pan end cap according to an example embodiment for use in the air conditioning system of FIG. 1.
Figure 6B:
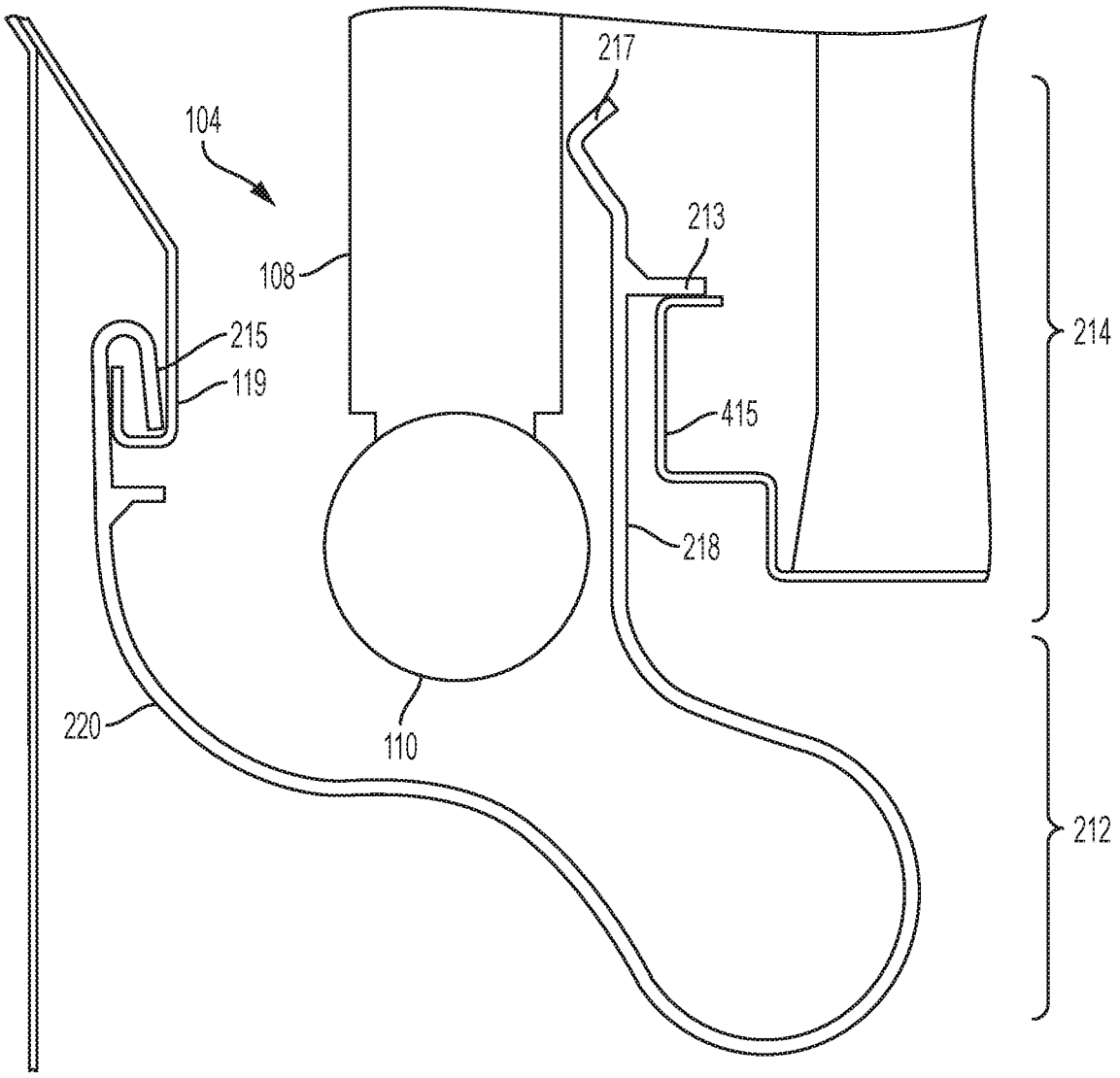
FIG. 6B illustrates a cross-sectional view of the drain pan's engagement with an evaporation coil of the air conditioning system of FIG. 1 according to an example embodiment.

In the illustrated embodiments, shroud portion 214 is substantially open at second end cap 206 (i.e. above the portion of end cap 206 that closes the longitudinal end of trough portion 212 and engages the bottom of header 110 of the evaporator) to allow drain pan 200 to receive evaporator coil 104 between flanges 218 and 220, and to allow the drain pan to be removed from below the evaporator coil without obstruction from the evaporator coil. Shroud portion 214 may be configured to prevent or limit air bypassing the evaporator coil 104. More specifically, flange 218 engages and creates a seal with the frame of the filter rack (FIGS. 12 and 13), as illustrated in FIG. 6B, thereby preventing air from bypassing below the evaporator coil as it is drawn into the evaporator by fan 111 (FIG. 1). Flange 218, in resting against or near the upstream face of the evaporator coil at 217, also prevents the possible spray of water from a section of the evaporator coil at which a gap exists between the coil fins and a header 110 at the bottom of the coil. As illustrated in the Figures, a slight gap may exist between the upper edge of flange 218 and the evaporator coil, but because the upper edge extends above the coil gaps between the fins and the header, the flange nonetheless deflects high velocity air flow.

First end cap 204 defines a first aperture 208 therethrough that is in fluid communication with an interior volume of trough portion 212 so that the first aperture is configured to drain the condensate from drain pan 200 from trough portion 212. First aperture 208 may be threaded and/or tapered to receive multiple types of piping connections, such as PVC connectors. It should be understood that various types of connections can be made between aperture 208 and a connector or directly between aperture 208 and a piping section (for example made of PVC), such as a threaded connection (which can be made in the field as part of installation) or through PVC cement or adhesive. In a first drain configuration, the condensate drains through first aperture 208 through piping (not shown) attached at aperture 208 to a drain 102 (e.g., 102B in FIG. 2), to which the other end of the intermediate pipe (not shown) is attached, thereby without flowing through drainage pipe 300 (FIG. 1). For example, a fitting attached to end cap 204 at aperture 208 couples a first end of an intermediate hose or pipe to first aperture 208, and the hose or pipe slopes continually downward (with respect to horizontal) from first aperture 208 to a second end of the hose or pipe that is disposed within or attached to the drain so that gravity induces flow from the intermediate hose's or pipe's first end to the second end at the drain.

In the illustrated embodiments, first end cap 204 also includes a second aperture 210. Drainage pipe 300 (FIG. 1) is aligned with and attached to end cap 204 at second aperture 210, such that a U-connector 209 may be installed to fluidly connect first aperture 208 of drain pan 200 to drainage pipe 300 that extends through second aperture 210. That is, for example, drain pipe 300 may be attached to aperture 210, e.g. by a thread connection or a pass through, so that U-connector 209 may make a fluid connection with pipe 300 either via a connection between U-connector 209 and aperture 210 or by direct connection between the U-connector and pipe 300, for example in either instance via a threaded connection or PVC adhesive. In some embodiments, U-connector 209 includes a condensate trap, e.g., a piping dip configured to trap a volume of liquid and prevent or limit air flow. In further embodiments, when attached between aperture 208 and drain pipe 300 at aperture 210, the U-connector has a continuous downward slope (with respect to horizontal) from aperture 208 to drain pipe 300 and aperture 210, thereby biasing condensate therein towards drain pipe 300. The connection of U-connector 209 between first aperture 208 and drainage pipe 300 via second aperture 210 provides a second drain configuration in that condensate that falls into trough portion 212 via flanges 218 and 220 drains down the trough portions and through first aperture 208 of the drain pan 200, through U-connector 209, through second aperture 210, through drainage pipe 300, and to drain 102A (FIG. 2) located beneath air conditioning system 100. As further stated below, both trough portion 212 and pipe 300 have continuously downward slopes (with respect to horizontal) so that condensate flows through trough portion 212 to aperture 208 and into the U connector, through the U connector to pipe 300 and aperture 210, and through pipe 300 to drain 102A (FIG. 2).

Figure 4:
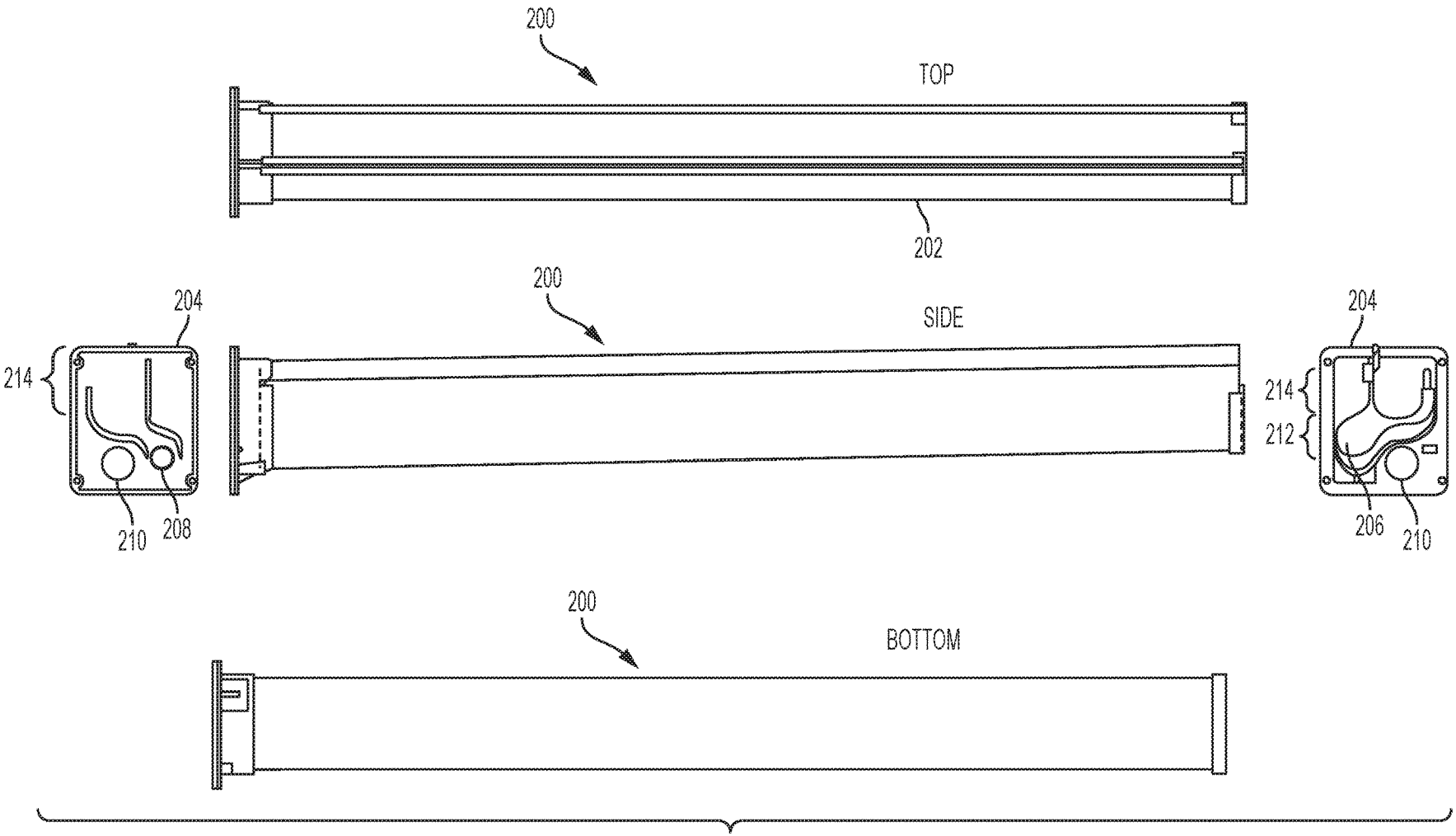
FIG. 4 illustrates top, side, and bottom views of an example drain pan according to an example embodiment for use in the air conditioning system of FIG. 1.

FIG. 4 illustrates top, side, and bottom views of an example drain pan 200 according to an example embodiment. As indicated by the side view, drain pan 200 has a generally linear bottom interior surface, when considered in its direction of elongation. The linear bottom slopes downward (with respect to horizontal) from second end cap 206 to first end cap 204 to thereby bias the flow of condensate toward first end cap 204. In other embodiments, only a portion of drain pan 200 slopes downward. Trough portion 212 is aligned with first aperture 208 at a first end of the trough portion and is closed at an opposing second end by second end cap 206. In some example embodiments, when installed in air conditioner 100, shroud portion 214 is substantially above drain pipe 300 (FIG. 1), as indicated by second aperture 210 in the side views. That is, aperture 210 aligns with drain pipe 300, and a portion of shroud portion 214 is disposed directly above aperture 210. In the illustrated embodiments, there is insufficient room to install both the shroud portion and the trough portion between the evaporator coil and the drain pipe. Thus, in such embodiments, trough portion 212 is positioned to one side of drain pipe 300, thereby allowing room for drain pipe 300 to be disposed beneath drain pan 200. Note, however, that the bottom of aperture 208 is higher than the bottom of aperture 210, so that there will be flow from the drain pan to drain pipe 300 when connected by the U connector. In general, trough portion 212 is positioned so that its lowest point, e.g. at aperture 208, is higher than the point at which condensate is directed into an inlet of drain pipe 300 to thereby enable sufficient drainage slope from drain pan 200 to drainage pipe 300.

Figure 5:
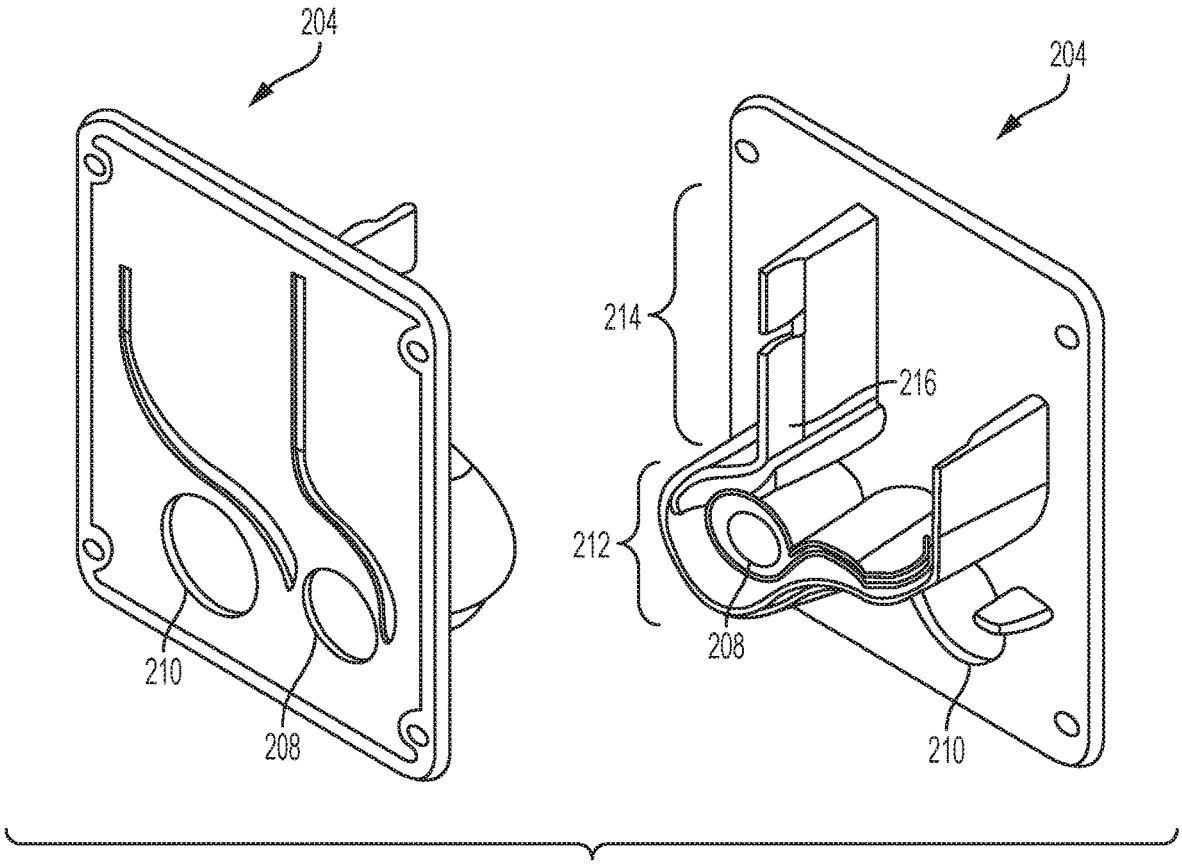
FIG. 5 illustrates perspective views of an example drain pan end cap according to an example embodiment for use in the air conditioning system of FIG. 1.

FIG. 5 illustrates perspective views of an example first end cap 204 of drain pan 200 (FIG. 3) according to an example embodiment. First aperture 208 is positioned at the lowest point within the interior of trough portion 212 to enable condensate to fully flow from the trough portion. In other words, condensate flows only downwards and does not require condensate to flow over a lip that would form if the lowest point of first aperture 208 were above the lowest point within the interior of trough portion 212. In some example embodiments, first end cap 204 includes one or more attachment elements 216 configured to couple first end cap 204 to drain pan 200. In the illustrated embodiment, attachment elements 216 are compression slots that match a portion of the side profile of drain pan elongated portion 202 (FIG. 3) and receive an end of elongated portion 202 within them in an interference fit, thereby coupling the elongated portion with the first end cap. In a further embodiment, various other mechanisms, such as adhesives, screws, fasteners, or the like, may be used, and in yet further embodiments, seals (e.g., o-rings) may be employed to seal elongated portion 202 to first end cap 204. FIG. 6A illustrates front, top, and side views of an example first end cap 204 of a drain pan 200 (FIG. 3) according to an example embodiment.

FIG. 6B illustrates a cross-sectional view of drain pan 200 engagement with an evaporator coil 104. As described above, drain pan 200 has a leading edge flange 218 and a trailing edge flange 220, where leading edge flange 218 engages the evaporator coil on the coil's upstream side (the side at which air enters the coil area), and trailing edge flange 220 engages the sheet metal feature 119 of the fan housing at the coil's downstream side (the side at which air passes out of the evaporator). Lateral flange 213 extending from leading edge flange 218 rides on a sloped flange 415 (FIGS. 12 and 13) of rectangular frame 401 of an air filter rack 400 (FIGS. 12 and 13) disposed immediately upstream of the evaporator coil. The downward-facing opening formed by the hook-shaped upper flange 215 of trailing edge flange 220 receives the end portion of a correspondingly-sloped J-shaped trough 119 at the end of a surface of the blower deck 117 (FIG. 1). Each of blower deck trough 119 and flange 415 is sloped slightly downward (from right to left, in the perspectives of FIGS. 1, 12, and 13) to maintain drain pan 200 in the desired slope toward the drain pan's output, so that condensate received by the drain pan trough portion 212 drains therefrom. However, frictional engagements between lateral flange 213 and sloped flange 415, between hooked-shaped flange 215 and J-shaped trough 119, and/or between upper flange end 217 and the evaporator coil retain the drain pan in position so that the drain pan does not slide downward and out of position, although it should be understood that screws may extend through these components to hold the drain pan in position or that other mechanisms, such as clips to hold flange 213 to flange 415 and flange 215 to trough 119, may be used for this purpose. Further, an upper end 217 of the drain pan shroud portion flange 218 may engage the evaporator coil, although a tight engagement is not necessary. As apparent from the discussion above, drain pan 200 occupies a gap between the blower deck and the air filter, underneath the evaporator coil. In particular, air filter frame bottom flange 415 and leading edge flange 218 of drain pan 200 block a flow path for air coming through the air filter frame underneath the evaporator coil, thereby forcing air through the evaporator that might otherwise bypass the evaporator.

As should be understood, evaporator coil 104 may be constructed so that the evaporator coil is formed as a plurality of fins that extend generally above and transverse to a generally cylindrical header 110, the axis of which extends into and out of the page in the perspective of FIG. 6B. Thus, gaps exist (again, into and out of the page in the perspective of FIG. 6B) between adjacent fins, just above the header. In an example embodiment, leading edge flange 218 projects higher away from drain pan 200 than does trailing edge flange 220 to thereby block microchannel coil openings between a plurality of fins 108 and header 110 to prevent or limit water spray therefrom. The height of flange 218, to 217, blocks high velocity air from the air filters from flowing through the gap between header 110 and fins 108, thereby preventing water blow-off from the water moving down off of the coils into the drain pan. The height of 218/217 is chosen to be sufficient to prevent or substantially inhibit water blow-off without adversely affecting air flow into the evaporator coils. Limiting or preventing water blow off reduces or prevents corrosion of materials or damage to electrical components of air conditioning system 100.

Figure 7:
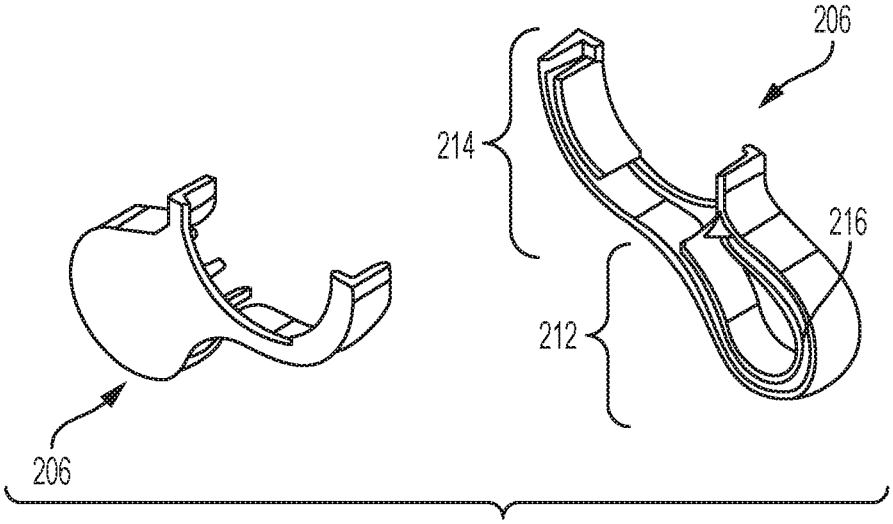
FIG. 7 illustrates perspective views of a second drain pan end cap according to an example embodiment for use in the air conditioning system of FIG. 1.
Figure 8:
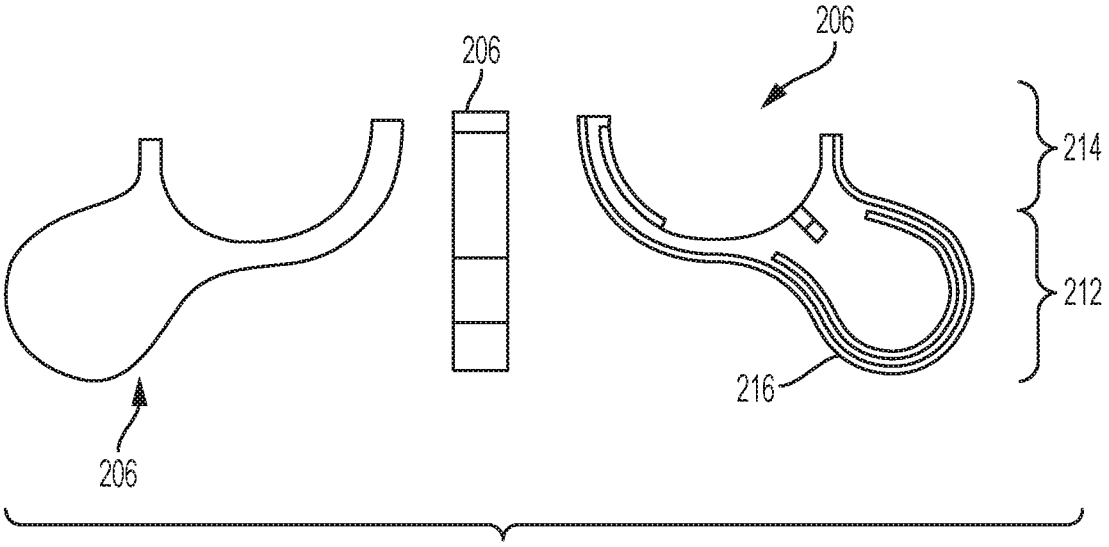
FIG. 8 illustrates side views of a second drain pan end cap according to an example embodiment for use in the air conditioning system of FIG. 1.

FIG. 7 illustrates perspective views of a second end cap 206 of drain pan 200 (FIG. 1) according to an example embodiment. In having an opening at shroud portion 214, drain pan 200 may be removed without obstruction by evaporator coil 104; when removing drain pan 200, evaporator coil 104 fits within and above shroud portion 214. Second end cap 206, like first end cap 204, also includes attachment elements 216 (i.e. compression slots) that mate with and match a side profile of a side of elongated portion 202 so that elongated portion 202 fits within the attachment elements 216 in a compression fit, thereby coupling second end cap 206 to elongated portion 202. FIG. 8 illustrates side views of a second end cap 206 of a drain pan 200 according to an example embodiment.

Figure 9:
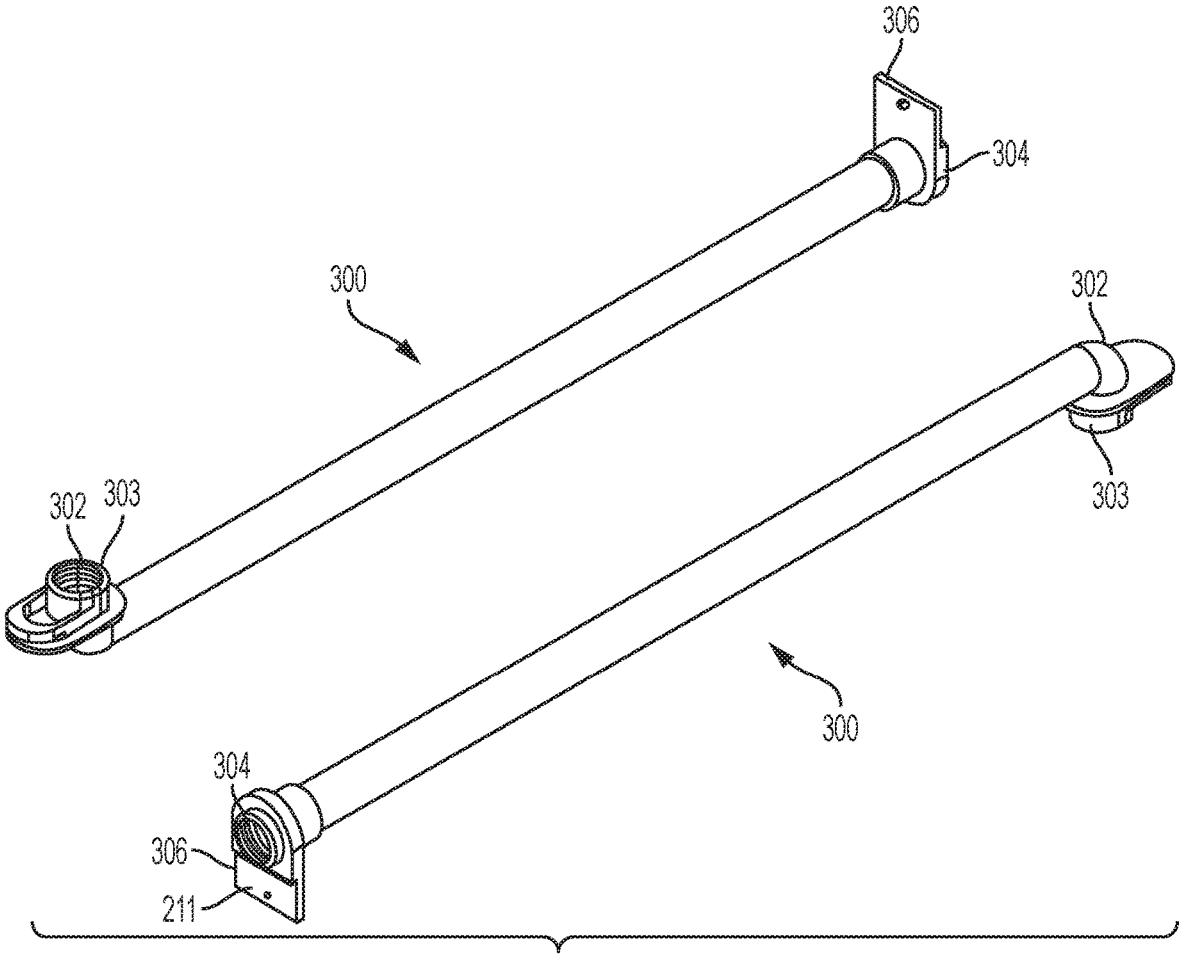
FIG. 9 illustrates perspective views of a drainage pipe according to an example embodiment for use in the air conditioning system of FIG. 1.
Figure 10:
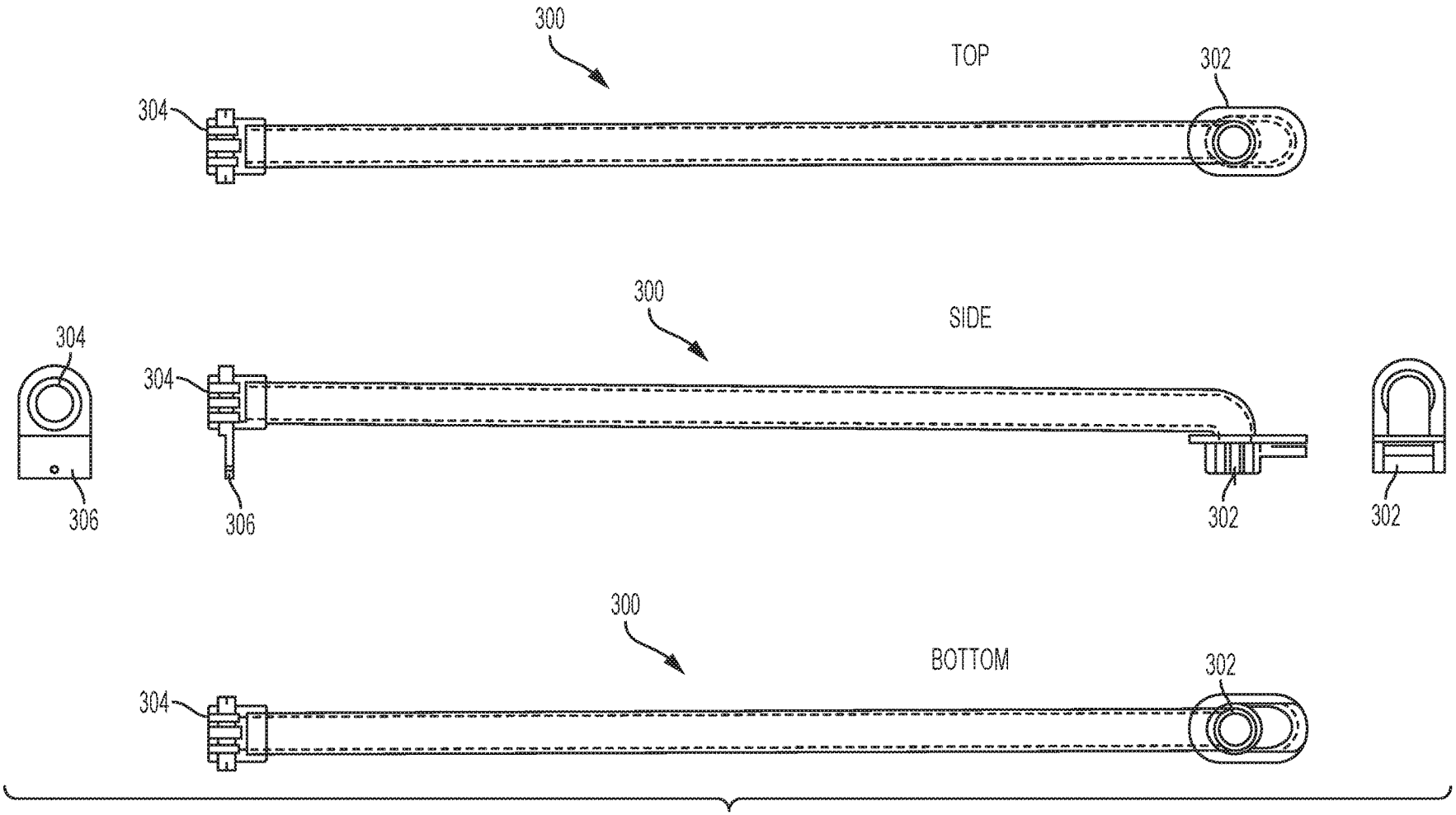
FIG. 10 illustrates top, side, and bottom views of a drainage pipe according to an example embodiment for use in the air conditioning system of FIG. 1.

FIG. 9 illustrates perspective views, and FIG. 10 illustrates top, side, and bottom views, of a drainage pipe 300 according to an example embodiment. Drain pipe 300 includes a side connection 304 that connects to end cap 204 of drain pan 200 (FIG. 3) at aperture 210, so that drain pipe 300 can be connected to drain pan 200 (via U-connector 209) to drain condensate from drain pan 200, through drain pipe 300, to a bottom drain 102, such as indicated at 102A (FIG. 2). Drain pipe 300 also includes a drain connection 302. Drain connection 302 includes a turn down, e.g. an approximately 90 degree turn in the pipe, toward a downward direction. Drain connection 302 is shaped to attach to a bottom drain 102, e.g. by a threaded or PVC adhesive connection. In some embodiments, the drain connection is shaped to maintain a position in an indoor base pan of the air conditioning system 100 (FIG. 1). In some embodiments, drain connection 302 includes a threaded or tapered connection for multiple types of piping connections, such as PVC connectors, to drain 102.

Side connection 304 includes an open end of the cylindrical pipe section comprising pipe 300, and a stabilizer 306 that surrounds the open distal end and depends downward therefrom. Stabilizer 306 is configured to maintain alignment of drainage pipe 300 in position with respect to air conditioning system 100 (FIG. 1), and in particular, to air conditioning system indoor base pan 207 (FIG. 1) when drain pan 200 (FIG. 1) is removed and replaced so that the open, distal end of the pipe remains aligned with second aperture 210 when drain pan 200 is replaced to its position underneath evaporator coil 104. Stabilizer 306 is operably coupled to the air conditioning system, indoor base pan, support structure, or the like. More specifically, stabilizer 306 is formed from a polymer (such as PVC), metal, or other suitable material in a generally plate-shaped member with a rounded top portion through which is formed a through-hole that receives the open, distal end of pipe 300. The through hole is configured to receive an expanded-diameter end portion of the pipe and to be attached thereto by any suitable mechanism, such as adhesive or welding, so that stabilizer 306 is fixed to the end of pipe 300. Stabilizer 306 has a generally planar-faced lower section 211 that is raised with respect to the forward face of the main body portion of the stabilizer. The distance between front face 211 and a lower, distal end 303 of pipe 300 is slightly greater than the distance between drain hole 102A and an inner edge of a side flange of indoor base pan 207. Thus, when end 303 of pipe 300 is received in drain hole 102A, the lower end of stabilizer 306 extends inside, and bears upon, the lip of inside base pan 207 so that face 211 bears against the base pan lip so that friction between those surfaces retains end 304, and through pipe 300, in position with respect to the base pan. Stabilizer 306 may also be attached to the base pan lip by a screw extending through both structures.

In an example embodiment, the side connection includes a slip fit between side connection 304 of drainage pipe 300 and U-connector 209 (FIG. 3). The slip fit allows a portion of U-connector 209 to be inserted into side connector 304 or a portion of side connector 304 to be inserted into U-connector 209, such that U-connector 209 and drain pan 200 (FIG. 1) may be removed and replaced without disassembly of joints and without tools. Particularly in embodiments in which U-connector 209 and side connector 304 are received one within the other, the two components can be held together through PVC adhesive or through a friction fit between the two components.

As depicted in the side view of drain pipe 300, all or a portion of drain pipe 300, may be angled downward to bias the flow of condensate toward drain connection 302. That is, the interior of pipe 300 is cylindrical in shape, so that, when the pipe is installed, the pipe interior has a generally linear center axis and a generally linear bottom interior surface, when considered in the pipe's direction of elongation. First end cap 204 is at a position with respect to base pan 207, and aperture 210 is positioned in first end cap 204, so that the pipe's longitudinal center axis, or linear elongated bottom surface, is disposed at an acute angle with respect to the horizontal, with pipe end 304 being higher than pipe end 302, when pipe end 302 is connected to drain 102A (FIG. 2).

In some example embodiments, the condensate drain assembly may be further configured for optional modifications. In this regard, for example, the condensate drain assembly also includes a U-connector configured to fluidly connect the first aperture of the drain pan to the drainage pipe via the second aperture in the second configuration. In some example embodiments, the drainage pipe is disposed substantially parallel to the longitudinal direction of extension of the drain pan. In an example embodiment, the drain pan is removed in the direction of longitudinal extension of the drain pan. In some example embodiments, the drain pan comprises a shroud portion and a trough portion, wherein the shroud portion is configured to face at least a portion of the evaporator coil of the air conditioning system to catch falling condensate and be substantially open at a second drain pan end cap to allow for the removal of the drain pan. In an example embodiment, the shroud portion is configured to prevent air from bypassing the evaporator coil of the air conditioning system. In some example embodiments, a leading edge of the shroud portion rests against the evaporator coil to block microchannel coil openings between a plurality of fins and the header to prevent water blow off. In an example embodiment, the trough portion is configured to translate the condensate toward the first aperture and is closed at the second drain pan end cap. In some example embodiments, at least a portion of the drain pan is angled downward to bias a flow of the condensate toward the first aperture and at least a portion of the drainage pipe is angled downward to bias the flow of condensate toward the drain. In an example embodiment, the drainage pipe includes a stabilizer configured to maintain alignment of the drainage pipe with the second aperture when the drain pan is removed and replaced.

In an embodiment, the air conditioning system can be used to cool air via a refrigeration cycle that uses a closed-loop refrigerant path. Referring to FIG. 1, the refrigerant path comprises an aluminum refrigerant conduit conducting refrigerant from a compressor, to a condenser coil, to an expansion valve, and then to evaporator coil 104, and back to the compressor. From the compressor, the compressed refrigerant passes through a condensing coil, transferring heat to air moving across the condensing coil in response to one or more fans 107 disposed within a housing 109 of air conditioning system 100. Condensed refrigerant from the condensing coil then passes through an expansion valve, lowering the refrigerant's pressure. The refrigerant from the expansion valve then passes through evaporator coil 104 and returns to the compressor. A first fan 111 pulls air over evaporator coil 104, thereby transferring heat from the air to the refrigerant (and thus cooling the air). Ductwork then directs the cooled air from fan 111 to a conditioned space. Return ductwork brings air from the conditioned space to fan 111, so than fan 111, the conditioned space, and the ductwork from a recirculating air path. Evaporator 104 is disposed either upstream or downstream of fan 111 so that the refrigerant flowing through evaporator coil 104 draws heat from the traversing air. Second fans 107 pull air ambient to air conditioning system 100 (i.e. ambient air) across the condensing coil so that the traversing air removes heat from the refrigerant flowing through the condenser. That is, there is a heat transfer from the refrigerant in the condenser to the air passing across the condensing coil. Typically, second fans 107 and the condensing coil are disposed externally of the space that is to be conditioned (e.g., placed on a roof or otherwise outside of a building for conditioning air within the building). The refrigeration cycle may be reversed in order to operate the system as a heat pump, wherein air is heated and then distributed to the conditioned space. In general, in such an embodiment, the refrigerant circuit includes a three-way (at least) reversing valve between the compressor, on the one hand, and the condenser and the evaporator, on the other, so that the reversing valve controls the directions of refrigerant flow into and out of the compressor. That is, as indicated above, in an air cooling mode, the reversing valve is configured to direct refrigerant from the compressor's output to the condenser's input and to direct refrigerant from the evaporator's output to the compressor's input. In a heat pump cycle, the flow of the refrigerant is reversed. The reversing valve switches, so that the valve directs hot refrigerant from the compressor's output to coil 104, i.e. the coil across which air passes before being distributed to the conditioned space, so that coil 104 operates as a condenser, contributing heat to the air being directed to the conditioned space. The refrigerant circuit (in response to pressure applied by the compressor to the closed refrigerant circuit) directs refrigerant from coil 104 to an expansion valve, which reduces the refrigerant's pressure, and then to the coil across which fans 107 move ambient air, drawing heat from the ambient air into the refrigerant as it changes state to a gas. The reversing valve receives the refrigerant flow from this coil's output and directs the refrigerant to the compressor, and the cycle repeats. Thus, the roles of the coils are reversed; the evaporator coil in air-cooling mode becomes the condenser coil in air-heating mode; and the condenser coil in air-cooling mode becomes the evaporator coil in air-heating mode.

The air conditioning system comprises a controller configured to actuate and deactuate the compressor and the fans. The controller determines this actuation based on one or more conditions, such as, for example, an air temperature measured by a thermostat located in the conditioned space and in communication with the controller that indicates that the space needs conditioned air (e.g., a temperature sensor in the thermostat senses that temperature of air in a room rises above a predetermined threshold temperature, triggering the thermostat to send a signal to the controller indicating to the controller that the room needs a supply of cold, conditioned air). In this embodiment, the controller, and in particular computer software instructions residing on a memory or other computer-readable medium so that the controller executes actions as dictated by the program instructions, is configured to actuate the reversing valve to switch the closed refrigerant loop and the air conditioning system between an air-cooling mode and an air-heating mode.

Figure 11:
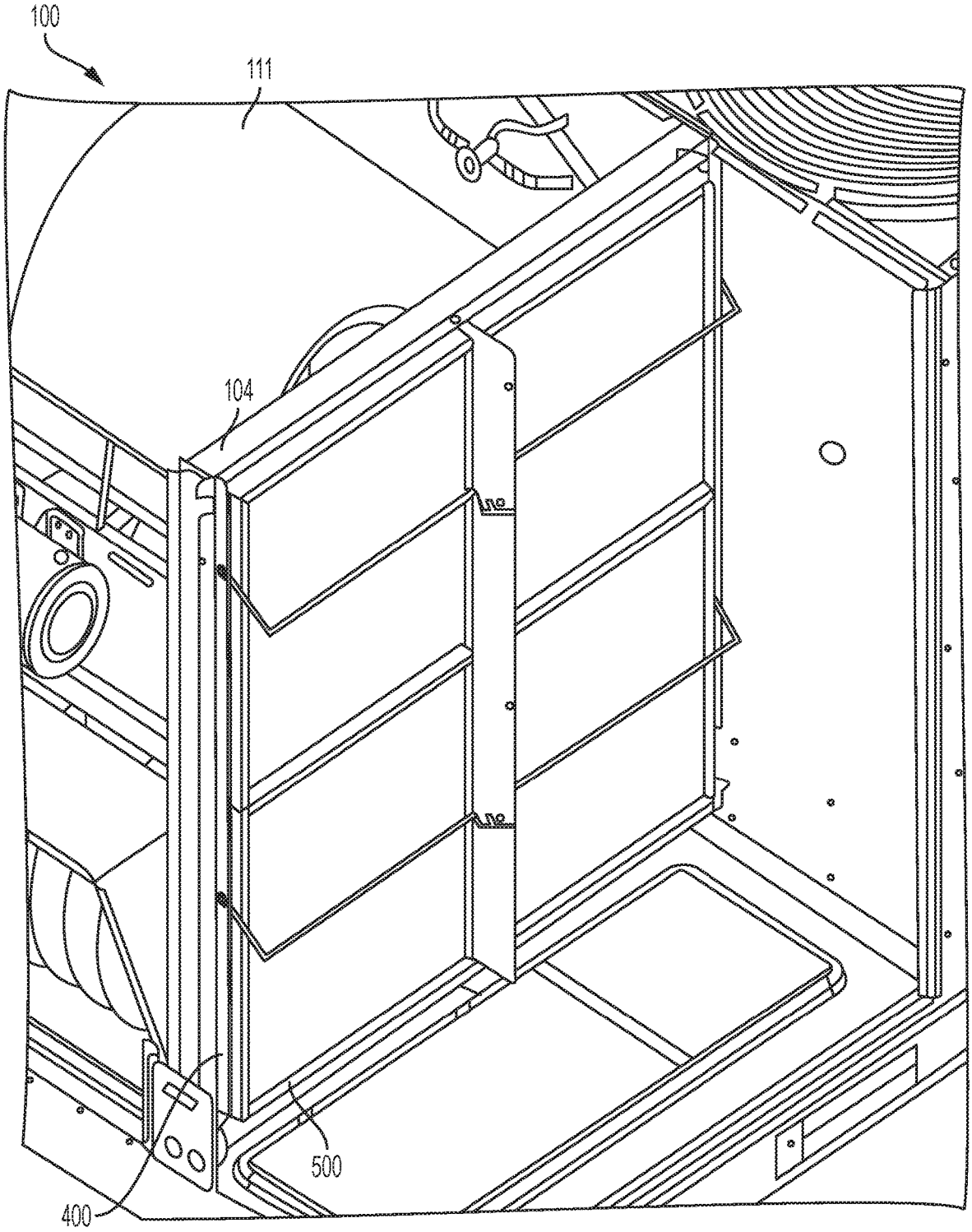
FIG. 11 illustrates a partial view of the air conditioning unit of FIG. 1 having an air filter rack.
Figure 12:
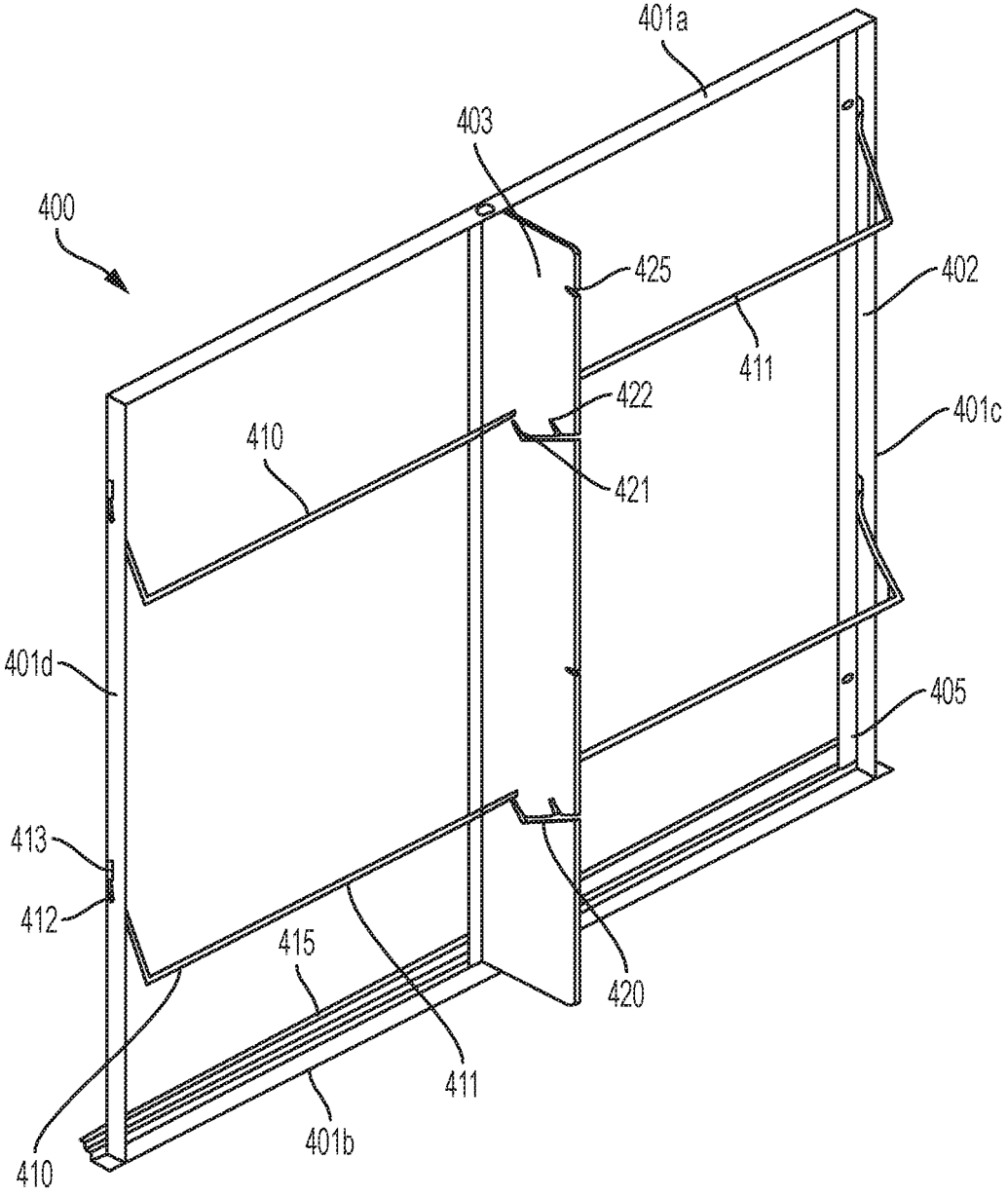
FIG. 12 illustrates a perspective view of the air filter rack of FIG. 11.
Figure 13:
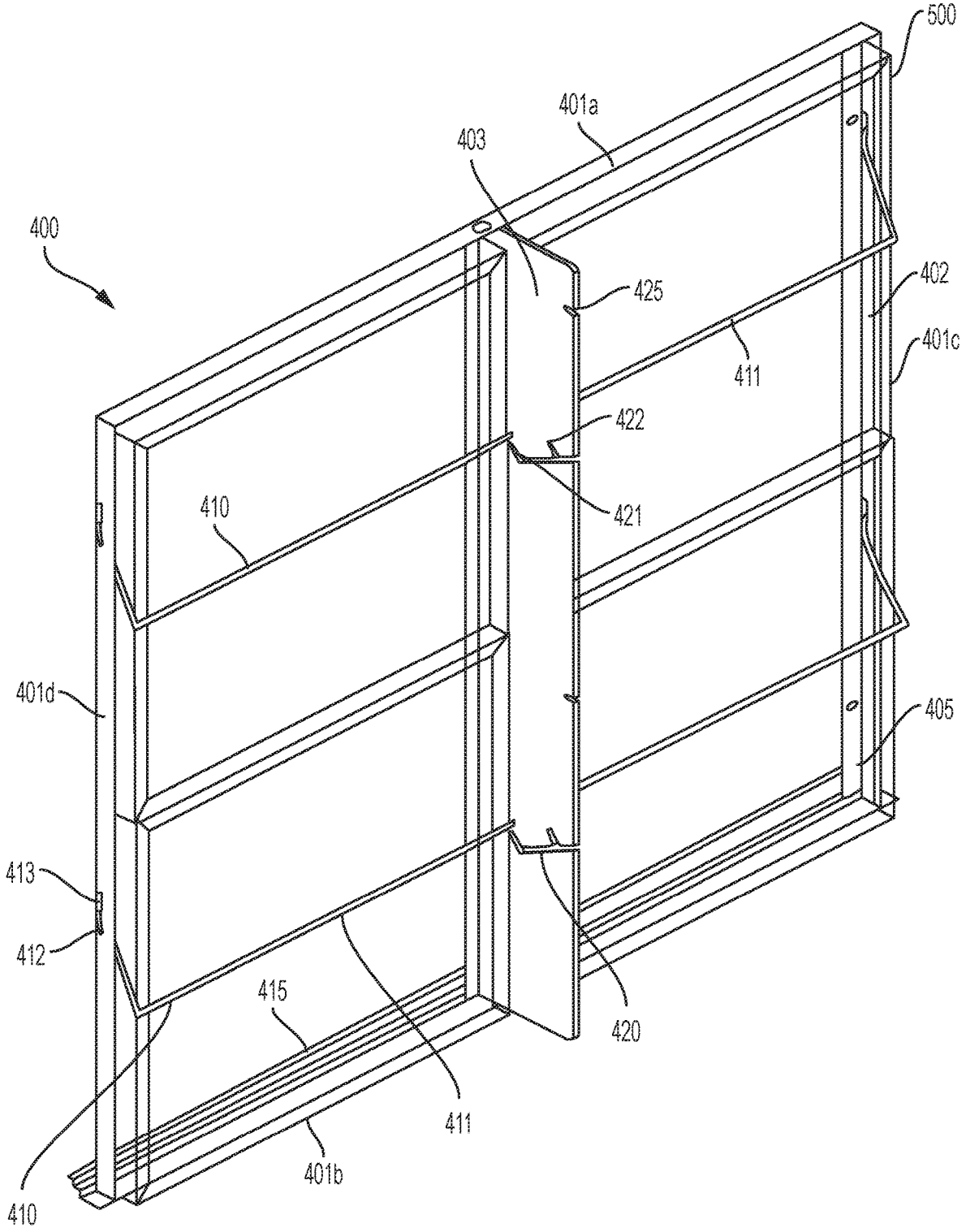
FIG. 13 illustrates a perspective view of the air filter rack of FIG. 12 with filters disposed therein.

Air passing across the coil that acts as an evaporator coil during the air cooling cycle, or, put another way, the coil disposed within the recirculating air flow to and from the conditioned space, is typically filtered to remove dust and dirt particles. In an embodiment, a filter is placed on an intake side of the air conditioning system so that air flows through the filter before passing over this "indoor" coil. As used herein, the term "indoor" coil refers to the coil used for heat transfer with the recirculatory air stream that moves air to and from the indoor conditioned space, regardless of the coil's physical location. That is, the "indoor" coil is the coil in the recirculatory air stream that serves (typically indoor) conditioned space, regardless of whether the coil itself is indoors or out. FIG. 11 illustrates a rack 400 within air conditioning system 100 for holding one or more filters 500. In an embodiment, and referring also to FIGS. 12-13, which illustrate rack 400 without and with filters, respectively, rack 400 is configured to hold filters having either of two different thicknesses as measured in the general direction of air flow across the filter and the indoor coil, e.g., two inch-thick and four inch-thick filters. Referring to FIGS. 11-13, rack 400 comprises a rectangular frame 401 comprising fabricated sheet metal components. Frame 401 includes an elongated top rail 401*a*, and an elongated bottom rail 401*b* parallel to the top side, an elongated first side rail 401*c*, and an elongated second side rail 401*d*. The side rails are spaced apart from each other in a first direction (the direction of elongation of the top and bottom rails) and extend transverse to the top and bottom rails. The top and bottom rails are spaced apart from each other in a second direction perpendicular to the first direction, thereby defining a channel 402 having a generally rectangular boundary defined by the four side rails. Thus, interior surfaces of channel 402 are configured to restrict movement of one or more filters in the first and second directions but allows filters to be inserted in a third direction perpendicular to both the first and second directions.

Frame 401 further includes a partition 403 extending vertically within channel 402 between top and bottom rails 401*a* and 401*b* and bisecting the channel to create sub-channels with rectangular cross-sections. Each sub-channel is of a size and shape so that a given filter 500, also having a rectangular profile, fits within either of the two sub-channels so that each sub-channel supports at least a portion of an exterior of filter 500's frame, and the filter fully covers the through channel across the width of the sub-channel so that any air passing through the sub-channel width must pass through the filter. In the illustrated embodiment, each sub-channel receives two filters stacked vertically, one on top of the other, although it should be understood that each sub-channel could receive a single filter (e.g., twice the height of the two filters) or more than two filters, depending on the given filter's or filters' height. A generally planar flange 405 extends inward (e.g., towards the channel center) from and generally perpendicular to each of the four generally planar side rails of channel 402 to provide a stop surface against which a front face of each filter 500 rests.

Two retaining wires 410, one per vertically-stacked filter in the illustrated embodiment, extend between side rails 401*c* and 401*d* and are received in receiving slots formed in partition 403, as discussed below, to retain filters 500 against the back sides of the filter rack. In this manner, filters 500 are held between flanges 405, interior rail surfaces of channel 402, partition 403, and wires 410. As shown in the Figures, an upper retaining wire 410 holds an upper row of two filters 500, and a lower retaining wire 410 holds a lower row of filters, but this is just for purposes of illustration.

Wire 410 is made of galvanized steel and is shaped to generally conform to the outer geometry of the filters. In this example, wire 410 has a generally U-shape with less-than-90 degree bends, having an elongated portion 411 against which filters 500 rest. Each distal end of a given wire 410 is bent into a 180 degree hook-shape 412 that loops through a hole 413 in respective side rails of channel 402 in order to enable wire 410 to pivot around an axis, the axis defined by a line drawn between and through holes 413 in the opposing side rails of channel 402. Because the bends in the wire (between the elongated front portion of each wire that extends across the front of the filter and the side portion of the wire) are slightly less than 90 degrees, the engagement of wire ends 412 in holes 413 forces the wire sides outward, closer to 90 degrees with respect to the front portion of the wire and thereby introducing an inwardly directed bow in the front part of the wire that tends to bias the filter back toward and against flange 405. Because of wire 410's U-shape, elongated portion 411 is non-coaxial with wire 410's axis of pivot. In this way, wire 410 may be pivoted around the axis so that elongated portion 411 is displaced away from filter 500 to enable filter installation and removal, and then pivoted back to hold filter 500 in place.

Partition 403 has slots 420 (one for each corresponding wire 410), each configured to receive elongated portion 411 of wire 410 and hold wire 410 in place. Slots 420 are cut into partition 403 and are shaped so that the deepest point in a first notch 421 is spaced in the third direction from flanges 405 correspondingly to a predetermined first filter thickness, and a second notch 422 has a deepest point therein spaced from flanges 405 in the third direction correspondingly to a predetermined second filter thickness. Therefore, when elongated portion 411 is disposed within the first notch, it holds a filter having a first thickness so that the filter has minimal play in the third direction, and when elongated portion 411 is disposed within the second notch, it holds a filter having a second thickness so that the filter has minimal play in the third direction.

The bottom of each slot 420 is spaced a greater distance from wire 410's axis of pivot than the distance between wire 410's pivot axis and elongated portion 411's axis when wire 410 is not under tension. In this way, in order to engage wire 410 within its corresponding slot 420, it must be bent under an externally-applied tension, e.g. by hand, and the galvanized steel wire is sufficiently flexible to bend slightly in response to hand pressure for the purpose of moving the wire between notches 421 and 422, which is the normal operative range in which the wire is moved. Further, the deepest points of notches 421 and 422 are the closest points within notches 421, 422 to wire 410's axis of pivot so that wire 410 settles to the deepest point within the notch, where wire 410 is under the least amount of tension within each notch. Thus, the notches act as detents so that wire 410 naturally settles within the notches at the deepest points of the notches, and requires externally-applied force (e.g., that provided by a user when replacing the filters) to remove the wire from the notches. Partition 403 further includes a notch 425 to hold wire 410 in a convenient place for enabling easy filter installation and removal.

In a further embodiment, the flexible wire retainer is substituted with a rigid bar retainer having a diameter that fits into the notch detents. The rigid bar is attached via two parallel arms, one attaching to each end of the rigid bar. The arms are hinged at an axis on the frame similar to wire retainer 410. The arms are telescoping and spring-biased towards a compact configuration so that an adequate force applied to the rigid bar in a direction away from the pivot axis causes the retainer be displaced away from the pivot axis. When the force is removed, the retainer retracts towards the pivot axis. Thus, the rigid arm may be pulled away from the pivot axis, oriented at a selected notch, and released into one of the detent notches in order to hold the filter in place. Similarly, the rigid arm may be pulled out of the detent notches to remove and replace the filter.

In yet a further embodiment, the retainer is pivotally attached to the frame via a pair of arms. A pair of ball detents, one disposed on each side of the frame, moves with respect to the angle of the arms. The pair of ball detents cooperates with base portions mounted on each side so that the retainer is configured to lock in place in at least two different locations. Each base portion has indentations that receive ball detents when the arms of the retainer (moving in parallel with each other) are pivoted at two different angles with respect to the frame so that the retainer is spaced a predetermined distance from a plane defined by the surface of the flanges of the frame facing the retainer, the predetermined distance corresponding with the thickness of the filters. In this way, the retainer may be locked in two different spacings from the aforementioned plane in order to accommodate different filter thicknesses.

Many modifications and other embodiments of the condensate drain assembly and filter assembly set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. A condensate drain assembly comprising:

a drain pan disposed below an evaporator coil of an air conditioning system, so that the drain pan receives condensate from the evaporator coil, wherein the drain pan is removably disposed within the air conditioning system, and wherein a lowest vertical position of a bottom surface of the drain pan is at an end of the drain pan, a drainage pipe having a first end disposed proximate and lower than the end of the drain pan and a second end secured to the air conditioning system so that the second end is in fluid communication with an exterior of the air conditioning system via an exterior surface of the air conditioning system and is below the first end so that fluid within the drainage pipe flows away from the first end and towards the second end; and a first drain pan end cap comprising:

a first aperture at the end of the drain pan so that fluid in the drain pan drains from the drain pan through the first aperture, and a second aperture aligned with the first end of the drainage pipe, wherein at least a portion of the drain pan is sloped downward to bias a flow of the condensate toward the first aperture and at least a portion of the drainage pipe is sloped downward to bias the flow of the condensate toward the second end.

2. The condensate drain assembly of claim 1 further comprising: a connector tube configured to removably attach in fluid communication with the drain pan at the first aperture and the drainage pipe at the second aperture so that the drain pan end and the drainage pipe first end are in fluid communication with each other.

3. The condensate drain assembly of claim 1, wherein the drain pan and the drainage pipe are elongated and the drainage pipe is disposed substantially parallel to a longitudinal direction of extension of the drain pan.

4. The condensate drain assembly of claim 1, wherein the drain pan is removable from the air conditioning system in a direction of longitudinal extension of the drain pan.

5. The condensate drain assembly of claim 4, wherein the drain pan comprises a shroud portion and a trough portion, wherein, when the drain pan is installed at the air conditioning system, the shroud portion disposed below at least a portion of the evaporator coil of the air conditioning system receives the condensate therefrom, and wherein a second drain pan end cap opposite the first drain pan end cap is substantially open in the direction of longitudinal extension of the drain pan to allow for the removal of the drain pan.

6. The condensate drain assembly of claim 5, wherein the shroud portion is configured to prevent air from bypassing the evaporator coil of the air conditioning system.

7. The condensate drain assembly of claim 6, wherein a leading edge of the shroud portion rests against the evaporator coil to block microchannel coil openings between a plurality of fins of the evaporator coil and a header to prevent water spray therefrom.

8. The condensate drain assembly of claim 5, wherein the trough portion is configured to translate the condensate toward the first aperture and is closed at the second drain pan end cap.

9. The condensate drain assembly of claim 1, wherein the drainage pipe includes a stabilizer configured to maintain alignment of the drainage pipe with the second aperture when the drain pan is removed and replaced.

* * * * *